United States Patent [19]

de Laforcade

[11] Patent Number: 4,858,792

[45] Date of Patent: Aug. 22, 1989

[54] STORAGE AND DISPENSING DEVICE

[75] Inventor: Vincent de Laforcade, Vincennes, France

[73] Assignee: L'Oreal, Paris, France

[21] Appl. No.: 137,728

[22] Filed: Dec. 24, 1987

[30] Foreign Application Priority Data

Dec. 30, 1986 [FR] France ..... 86 18344

[51] Int. Cl.[4] ..... B67D 3/00

[52] U.S. Cl. ..... 222/533; 222/536; 222/538; 222/402.1; 222/545

[58] Field of Search ..... 222/527, 530, 533, 402.1, 222/402.13, 538, 556, 529, 536, 537, 545; 248/359 F, 359 H; 239/309

[56] References Cited

U.S. PATENT DOCUMENTS

| | | | |
|---|---|---|---|
| 3,169,673 | 2/1965 | Focht | 222/533 X |
| 3,276,641 | 10/1966 | Lehmann | 222/538 X |
| 3,476,111 | 11/1969 | Matheson | 222/527 X |
| 3,610,479 | 10/1971 | Venus, Jr. | 222/530 |
| 3,642,179 | 2/1972 | Micallet | 222/402.13 X |
| 4,013,231 | 3/1977 | Van Veldhoven . | |
| 4,219,135 | 8/1980 | Ufferflige . | |
| 4,234,127 | 11/1980 | Tada et al. | 222/533 X |
| 4,248,360 | 2/1981 | Crump | 222/174 |
| 4,305,528 | 12/1981 | Craig . | |
| 4,520,951 | 6/1985 | Facey . | |
| 4,728,007 | 3/1988 | Samuelson et al. | 222/538 X |

FOREIGN PATENT DOCUMENTS

| | | | |
|---|---|---|---|
| 8519968 | 10/1985 | Fed. Rep. of Germany . | |
| 1144385 | 3/1969 | United Kingdom | 222/527 |
| 2079183 | 1/1982 | United Kingdom | 222/538 |
| 2194598 | 3/1988 | United Kingdom . | |

OTHER PUBLICATIONS

French Search Report, Sep. 1987.

*Primary Examiner*—Joseph J. Rolla
*Assistant Examiner*—Gregory L. Huson
*Attorney, Agent, or Firm*—Cushman, Darby & Cushman

[57] ABSTRACT

A storage and dispensing unit includes a container for the product to be dispensed and a discharge conduit, a separate dispensing head has a part which is mountable on the container and includes a pivotally mounted part including a push button and discharge applicator which has one end in communication with conduits formed internally of the push button so that when the push button is pivoted from a stored position to a dispensing position, the internal conduits of the push button will be in communication with the discharge conduit of the container.

10 Claims, 4 Drawing Sheets

STORAGE AND DISPENSING DEVICE

The present invention relates to a device for the storage and dispensing of a product, wherein this dispensing takes place upon the manipulation of a push button which cooperates with an ejection element carried by the container containing the product to be dispensed. A tubular applicator is associated with the device to direct the product towards the zone to be treated in the form of a threadlike jet of either a fine mist or a foam.

The ejection element may be the dispensing valve of a pressurised container of the "aerosol can" type, or the reciprocating pump of a non-pressurized container.

The products which can be dispensed in this manner include by way of example, treatment products for the mouth and throat, cleansing or dental care products, and cosmetic products such as hair treatment products.

Many devices of this type are known, but all have drawbacks, mainly related to the fact that the applicator constitutes a bulky element. In fact, the solutions hitherto adopted to reduce this bulk when the said applicator is not in use are not really satisfactory because they lead to other difficulties. These latter will be briefly set out below with reference to some known devices.

U.S. Pat. No. 3,116,856 discloses a pressurised container of the "aerosol can" type whose ejection valve comprises an emergent outlet stem on which is fitted a push button associated with a guidance skirt capable of sliding along the external annular surface of the valve carrier cup of the container. The push button comprises an elbow-like duct which communicates the outlet stem of the valve with a tubular applicator formed by an attached element. This attached element comprises a rounded end which is pivotally received in the corresponding end wall of the push button. The applicator is therefore movable between a dispensing position where its duct is situated in the extension of the radial arm of the duct of the push button and a locked position where it comes to be folded against the lateral wall of the container, the bulge formed at its end cooperating with the push button closing the opening of the push button.

Such a device has the following drawbacks. In the locked position indicated above, manipulation of the push button is still possible and this can lead to the crushing of the elbow-like duct. Besides, the swivel type articulation obliges the user to manipulate the applicator at the time of use. Moreover, for packaging for the purpose of sale, it is necessary to separate the push button, whether or not it is pre-equipped with the applicator from the container which must then be protected by a cap. These features derive from the fact that manipulation of the push button remains possible even when the outlet duct of the push button is closed by the applicator. The resulting packages are very bulky. Furthermore, the dispensing head must necessarily be made of two distinct parts, that is to say, the push button and the applicator. Moreover, the applicator can always be disengaged from its recess, and the user then risks losing it.

U.S. Pat. No. 3,148,806 also discloses a pressurised container of the "aerosol can" type fitted with a push button comprising an external guidance skirt. The radially extending discharge duct of the push button opens out in a cylindrical housing which is coaxial with the duct, this housing being intended to receive, by a force fit but in a detachable manner, the shorter arm of an applicator bent in an L shape whose other arm constitutes the applicator-duct proper. The applicator can be swivelled around the axis of the shorter arm to be placed in the desired position. In the low position of the applicator proper a stop prevents depression of the push button. This eliminates certain drawbacks of the above mentioned device but other disadvantages nevertheless remain; for example it is obligatory to manufacture the dispensing head in two parts, there is a risk of losing the applicator, and there is a need for the user to manipulate the applicator to give it the desired orientation so the swivelling means has to be reliable.

U.S. Pat. No. 3,567,081 discloses a pressurized container of the "aerosol can" type whose push button is guided in a protective cap comprising a window for the passing of a relatively short tubular applicator whose free end is knee-shaped. The applicator is disposed in the extension of the radial duct of the push button and it can only swivel on itself. This embodiment, which nevertheless remains bulky, cannot be suited to applications requiring a relatively long applicator.

FR-A-2 462 360 discloses an applicator for an aerosol dispenser which is capable of occupying different positions in space thanks to a double articulation. Such a dispenser is not deemed to be practical, because the user is obliged to manipulate it to orientate the applicator. Moreover, it has the drawback of requiring several components for its assembly, which complicates industrial manufacture.

FR-A-2 377 336 describes a device for storing and dispensing a cleansing or dental care product, where the ejection element of a container, whether pressurised or not, is surmounted by a push button whose radially extending outlet duct is extended by an attached tubular conduit whose free end terminates in a dispensing end fitting which, in order to enable it to reach the less accessible zones of the denture, or to direct the cleansing or treatment product into the selected interdental space, either is made of a flexible and deformable material with a stiffening element to ensure it stops in the deformed position or is provided in a substantially rigid form but is able to swivel in relation to the push button or carries a dispensing end fitting in elation to the conduit. In all cases disclosed, there is a risk of losing the applicator element, as well as a need to provide a relatively sizeable packing.

Moreover, in FR-A-2 394 466, a dispensing head intended to be fitted on a container equipped with an ejection element comprises (a) a push button controlling the element and (b) an applicator, which are integrally formed by moulding a plastic material. In that case, although the applicator is not liable to be lost, the size of the package cartons remains a considerable disadvantage for industrial production.

Thus, in the prior art, there is no embodiment which has simultaneously eliminated the risk of losing the applicator and the making of the dispensing head in two parts, and frequently there is the requirement for the user to position and/or orientate the applicator at the time of use; there is also the drawback of an unduly large size of the packages.

The present invention aims to provide a solution for this problem by removing the two disadvantages which could never be abolished simultaneously in the prior art. There is also to be scope for an additional reduction of the horizontal bulk of the resultant device, and there are additional advantages constituted by a great simplicity in the application by the user and scope for manufacturing the dispensing head in one single piece.

Accordingly, the present invention provides a unit for storing and dispensing a liquid product, this unit comprising:

a container which contains the product to be dispensed;

a discharge means capable of cooperating with a push button on which the user acts to dispense said product, said push button comprising internally a first duct which in the dispensing position is disposed as the extension of the outlet conduit of said discharge means, said first duct issuing in a second duct substantially transverse in relation to the first, said second duct communicating with the outlet duct of an elongate applicator integral with said push button;

and a dispensing head having a first part to be mounted on the container, and a second part movable relative thereto;

wherein said applicator and said push button are integral and together constitute the movable part of said dispensing head, and the said second part of said dispensing head is articulated relative to the first part around a hinge to allow the displacement of the second part between a working position in which the push button cooperates with the discharge means when the applicator is orientated transversely in relation to the container and a storage position wherein the applicator is folded substantially parallel to the container and the push button no longer cooperates with the discharge means.

The push button and the applicator thus constitute a sub-assembly connected by the hinge to the first portion of the dispensing head which is capable of being fixed to the container, the above mentioned sub-assembly then being displaceable between (a) a storage position in which it comes to be placed alongside the container, either along the body thereof in a first embodiment or along the second portion of the dispensing head in a second embodiment, and (b) a dispensing position where the inlet duct of the push button is an extension of the outlet tube of the discharge means, the push button then being ready for operation and the applicator being in its dispensing position.

Preferably, the push button and the applicator are made from a single piece by moulding a plastic material.

It is also preferable for the second duct of the push button and the channel of the applicator to be extensions, one of the other.

The hinge may be disposed on the movable part of the dispensing head in a hinge zone which separates the push button from the applicator proper.

Moreover, the hinge connecting the first and second parts of the dispensing head is advantageously a film hinge. It could instead be a pin hinge.

The first part of the dispensing head may comprise means for guiding the second part of the dispensing head in its displacement between the storage position and the working position.

The storage and dispensing unit according to the present invention advantageously comprises a protective cap capable of being positioned as an extension of the container.

In a first embodiment, the hinge connecting the two parts of the dispensing head is approximately on the surface envelope of the container, the protective cap cooperating in the assembled position with the first part of the dispensing head whereas the second part thereof is then outside the protective cap and the container.

In a second embodiment, the hinge connecting the first and second parts of the dispensing head is situated inside the surface envelope of the container, the dimensions of the second part of the dispensing head and of the protective cap being chosen to allow the dispensing head in the storage position thereof to be completely accommodated in the internal space of the cap.

In order that the present invention may more readily be understood, two exemplary embodiments thereof will now be described with reference to the accompanying drawings, in which:

FIG. 1 is an elevation of a first embodiment of a device for storing and dispensing a mouth care product in accordance with the invention, such device comprising a pressurized container associated with a dispensing head and a protective cap, the cap being shown in its position closing the container and the dispensing head being shown in the corresponding position where its tubular ejection conduit (viewed sideways in this Figure) is positioned alongside the body of the pressurised container;

Figure 1:
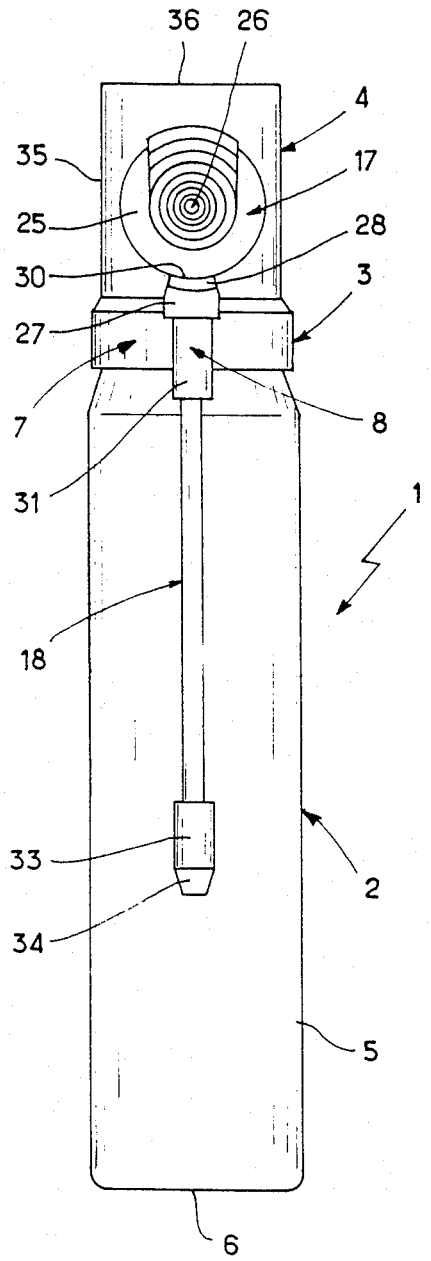
Figure 2:
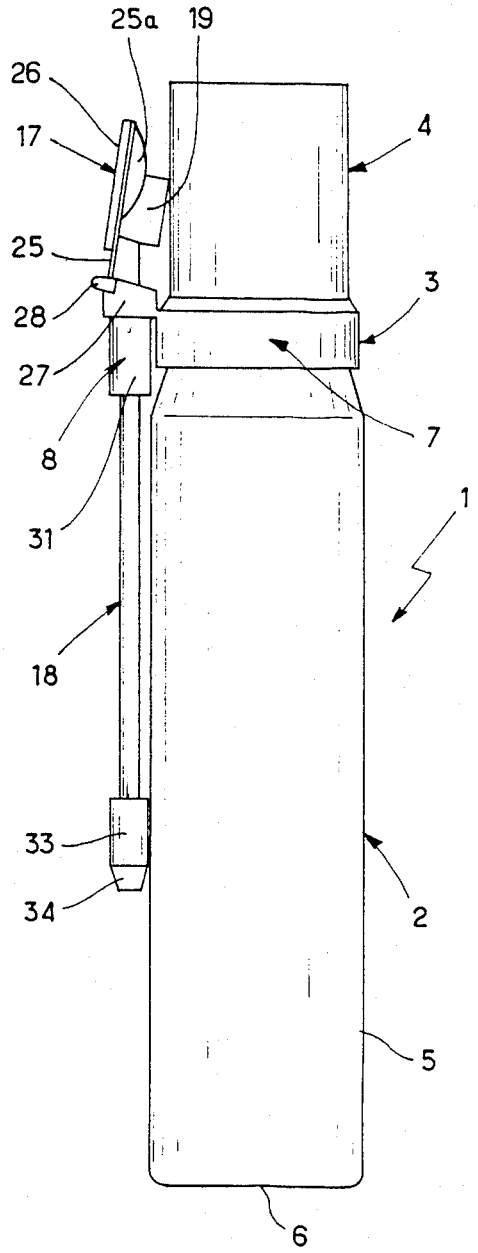
FIG. 2 is a view similar to FIG. 1, but differing in that the dispensing tube is shown in profile.
Figure 3:
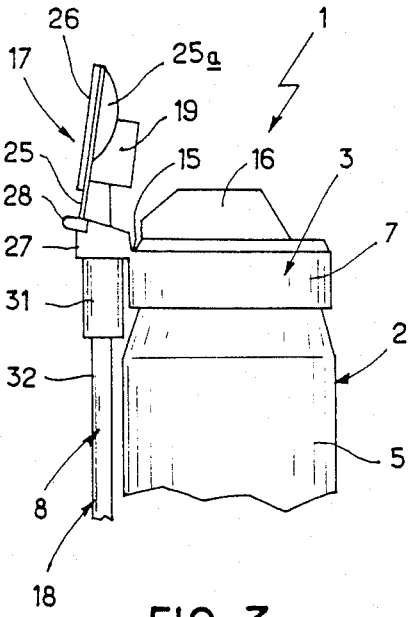
FIG. 3 is a view similar to FIG. 2, but showing only the upper portion of the container, the protective cap having been removed, and the dispensing head having remained in the same position.

Referring now to FIGS. 1 to 5 and 8, there will be seen a device generally intended for the storage and dispensing of an oral treatment product. This device is constituted by a pressurised container 2 of the "aerosol can" type, whereon there is fitted a dispensing head 3, as well as a detachable protective cap 4.

The generally cylindrical pressurised container 2 comprises a lateral wall 5 joined to a bottom 6 and having a valve carrier cup fixed by crimping on the upper end edge of the lateral wall 5. In the central zone of the valve carrier cup, is a valve provided with an emergent discharge tube. The valve carrier cup, the valve and its outlet tube are omitted from the above-mentioned Figures. In fact, they have a completely conventional structure. If the outlet tube of the valve is depressed, the contents of the container 2 are exposed to the atmosphere and are then ejected from the container 2 under the effect of the propellant gas therein.

On the container 2 is fitted the dispensing head 3 constituted by one part called the fixed part 7 fixed on the container 2, and by a movable part 8.

Figure 5:
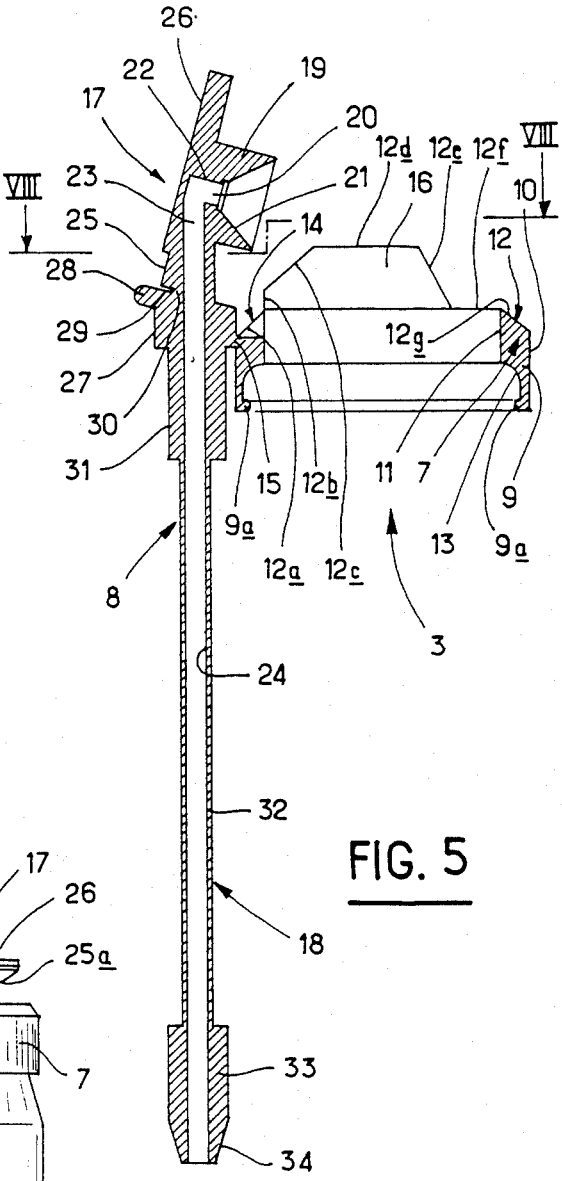
FIG. 5 is an axial cross-sectional view of the dispensing head shown in the position it occupies in FIGS. 1 to 3, the cross-section having been taken on the radial plane which includes the axis of the tubular ejection duct.

As may be seen in FIG. 5, the fixed part comprises a peripheral skirt 9 having internally near its free lower edge a bead 9a which, in the assembled position of the head 3, cooperates with the peripheral groove resulting from the operation of crimping the valve carrier cup onto the lateral wall of the body of the container 2.

The skirt 9 has a cylindrical external wall 10 and an also cylindrical internal wall 11 having, substantially at mid height, a set back 13 whose profile has the shape of a circular arc and beneath which the skirt 9 has a smaller thickness.

Figure 8:
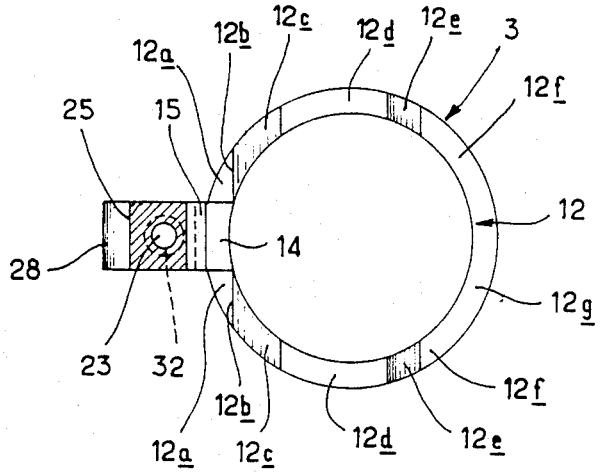
FIG. 8 is a cross-section along line VIII—VIII of FIG. 5.
Figure 9:
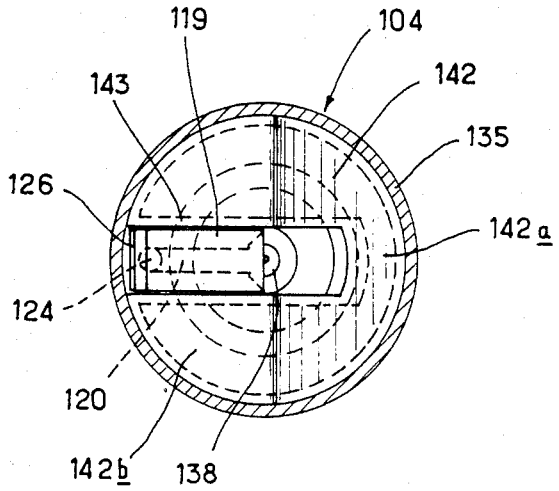
FIG. 9 is a cross-section along line IX—IX of FIG. 6.

If reference is now made to FIG. 8, there may be seen a channel-shaped cut out 14 along the upper edge of the skirt 9, the external free edge of the skirt 9 being, at the level of this cut out 15, connected to the movable part 8 of the dispensing head 3 by a thin film hinge 15. The width of the cut out 14 corresponds to the width dimension of this movable part 8 at this point.

On either side of the cut out 14, the upper edge 12 of the skirt 9 has a zone **12*a* where it is chamfered in a downwardly flaring configuration. On the side remote from the cut out 14, the edge 12 is chamfered in the same way at 12*g* and between zones 12*a* and 12*g* are symmetrically and successively a vertical set back 12*b*, a slanting portion 12*c*, a flat portion 12*d*, another slanting portion 12*e* and then a flat portion 12*f*. Thus there are constituted lateral elements 16 for guiding the movable part 8** as will now be described.

This movable part 8 is constituted by a zone 17 forming a push button and by a zone 18 forming the applicator proper.

As may be seen from FIG. 5, the push button 17 is constituted by a cylindrically shaped body 19 comprising, along its axis, a bore 20 which opens out towards the outside in a widely divergent frustoconical part 21 whose height is substantially half that of the body 19. The cylindrical conduit 22 which extends the frustoconical opening 21, branches to constitute a branch 23 continuing to the zone 18, where it constitutes the ejection duct 24 of the applicator. The branches 22 and 23 together form an angle of the order of 60°.

On its side remote from the opening 21 the push button 17 is in the form of a disc-shaped plate 25 whose centre is situated on the axis of the bore 20 and which constitutes the action zone for the finger of a user wishing to perform a dispensing action. To facilitate this action, the disc 26 has a portion 26 with increased thickness and an external striated surface. This extra thick striated zone includes the central circular zone of the disc 25 and its extension on the side remote from the zone 18 forming the applicator, as far as the free edge of the disc 25 over a section delimited by two tangents to the circle forming the central circular zone. The disc 25 is joined to the remainder of the applicator 18 by means of a connecting element 27. This element 27 comprises an external bead 28 separated from the disc 25 by a slit 29 (FIG. 5) defining a circular area with the same centre as the disc 25. This leaves a zone forming the hinge 30 for the manipulation of the push button.

The disc 25 carries externally on the same side as the body 19, two wings 25a situated on either side of this body 19.

The connecting element 27 extends from the hinge zone 30 to the above mentioned thin film hinge 15 interconnecting the movable part 8 and fixed part 7 of the dispensing head 3.

The applicator 18 may be considered as comprising three successive parts from the connecting element 27 as far as its free end, that is to say, a cylindrical part 31 of larger external diameter, then a main central part 32 of smaller diameter, and finally an end fitting 33 whose external diameter is substantially equal to that of the zone 31, but whose external edge 34 is chamfered.

The device is completed by a protective cap (FIGS. 1 and 2) constituted by a lateral cylindrical skirt 35 joined to a top panel 36. The protective cap 4 is fitted on the fixed part 7 of the dispensing head 3 while its movable part 8 is in an outwardly tilted position (represented in FIGS. 1 to 3) wherein the part 17 constituting the push button is displaced outwardly still further beyond the released portion represented in FIG. 5 until the applicator 18 has its end fitting 33 resting against the wall 5 of the container 2.

Figure 4:
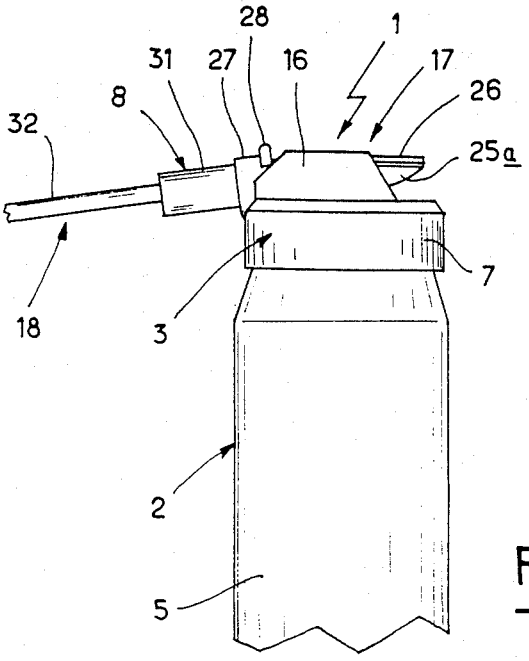
FIG. 4 is a view similar to FIG. 3 but showing the dispensing head in the operating position.

A user wishing to use the device 1 removes the protective cap 4 and pushes on the disc 25 of the push button 17 to cause the movable part 8 of the dispensing head 3 to rock into the operative position represented in FIG. 4. In this position, the push button 17 cooperates with the outlet stem of the valve in the conventional way, and when the user continues his lowering action the valve is actuated and a jet of the product to be dispensed is discharged through the bore 20 and the dispensing duct 24 and dispensed by the end fitting 33.

Figure 7:
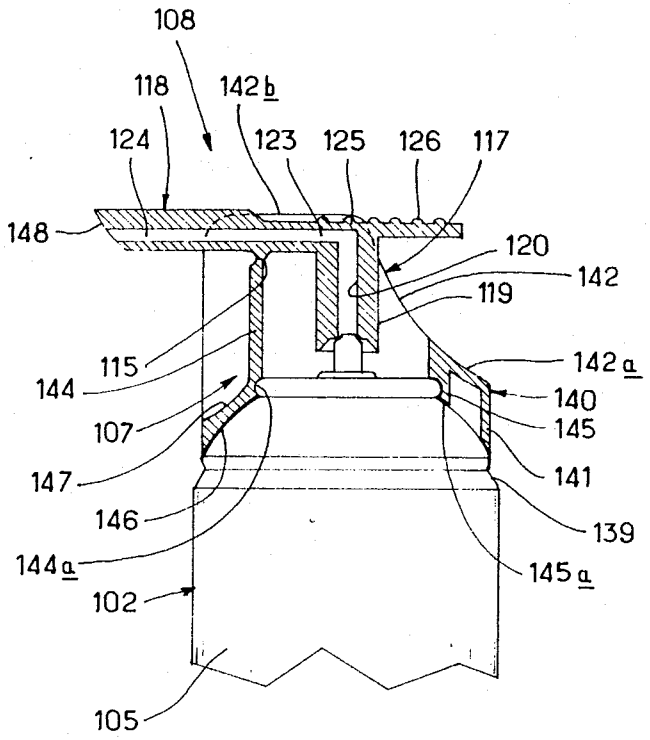
FIG. 7 is a view similar to FIG. 6 but showing the dispensing head in its operating position, the protective cap having been removed.
Figure 6:
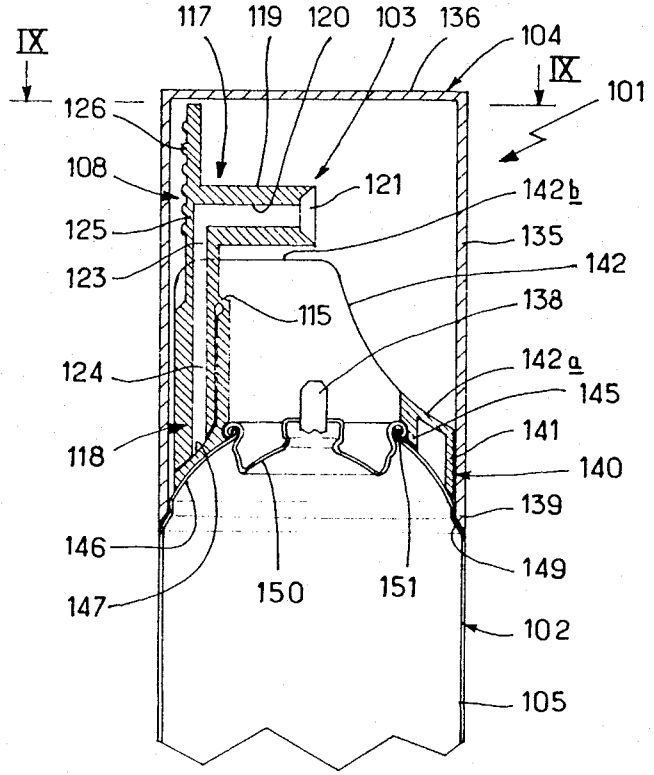
FIG. 6 is a view of the upper portion of a second embodiment of a device in accordance with the present invention, the protective cap having been shown in position on the pressurised container, and the container having been illustrated in elevation whereas the cap and the associated dispensing head are shown in axial cross section.

FIGS. 6 and 7 show that 101 designates in its entirety a second embodiment of a device in accordance with the invention, comprising again a container 102, a dispensing head 103, and a protective cap 104.

The container 102 comprises a lateral wall 105 joined on the one hand to a bottom and, on the other hand, to a valve carrier cup 150 by means of a crimped portion 151. The valve is a conventional valve having an emergent outlet tube 138. Moreover, the lateral wall 105 is cylindrical and progressively narrows to constitute a domed portion near the crimped zone. An annular peripheral set back 139 is formed in the wall of the container 102 between its cylindrical zone and its upper domed zone.

As in the first embodiment, the dispensing head 103 comprises a fixed part 107 and a movable part 108.

The fixed part 107 is constituted by a cap 140 having a cylindrical lateral wall 141 joined to a top panel 142 which comprises, over one half a slanting wall **142*a* and over the other half, a flat wall 142*b*. A channel-shaped recess 143 extends radially through the top 142 from the centre of the zone 142*b* down as far as the zone 142*a*, this cut out 143 being extended in the lateral wall 141 of the cap 140, so as to allow pivoting of the movable part 108** as will be described below.

In the mounted position, the lower edge of the cap 140 is just beneath the annular set back 139. This cap 140 is fixed on the container 102, on the one hand by a front portion 144 which is an element having the shape of a cylindrical portion, disposed opposite the open zone of the portion **142*b* of the top 142 and perpendicular to this top, and on the other hand, by a fastening sector 145 also having the shape of a cylindrical portion but carried by the portion 142*a* of the top 142 and being diametrically opposite the front portion 144**.

The front portion 144 and the fastening sector 145 each comprise a respective groove **144*a* and 145*a* cooperating with the external bead of the valve carrier cup. Moreover, the front portion 144** is extended by a flap 146 which covers the upper domed portion of the container 102 and which connects with the front portion 144 to the rest of the cap 140. The cover flap 146 externally comprises a boss 147 whose function will be indicated below.

As in the earlier embodiment, the portion 108 comprises two zones, namely a zone 117 constituting the push button and a zone 118 constituting the applicator proper. The push button 117 comprises a cylindrical body 119 traversed by an axial bore 120 which is connected to a perpendicular duct 123 which is extended as the duct 124 of the applicator element 118. Similarly, the push button 117 forms, at the end remote from the frustoconical inlet 121 of the bore 120, a small strip 125 having a striated portion 126 which constitutes the bearing surface for the user's finger for the manipulation of the push button 117.

The applicator element 118 is formed by a tubular conduit whose wall thickness increases beyond the connection to the film hinge 115 formed at the upper part of the front portion 144. The free end 148 of this tubular conduit is chamfered so that in the storage position represented in FIG. 6 it can bear against the cover flap 146 whose boss 147 is then in the outlet opening of the conduit 124.

The protective cap 104 comprises a cylindrical lateral wall 135 joined to a top panel 136, the cylindrical wall 135 comprising a chamfered free lower edge 149 which comes to be engaged in the groove 139 in the mounted position of the protective cap 104 on the container 102.

As indicated above, in the storage position, the movable part 108 of the dispensing head 103 is completely tilted around the film hinge 115, placing the applicator 118 parallel to the axis of the container 102, the body 119 of the push button 117 being perpendicular to said axis.

A user wishing to use the device 101 starts by removing the protective cap 104 and then pivots the movable part 108 by pressing on the zone 125 of the push button 117. The movable part 108 then assumes the position represented in FIG. 7 and the user, by continuing his lowering movement opens the dispensing valve and causes ejection of the contents from the container 102.

This second embodiment has the additional advantage of being very small in size, since the dispensing head is entirely accommodated in the space delimited by the protective cap 104 in the storage position.

I claim:

1. A unit for storing and dispensing a liquid product, the unit comprising:

a container for the product to be dispensed, said container having a discharge means including an outlet conduit, a dispensing head including a first part mounted on said container and a second part which includes a push button, said push button comprising internally a first duct and a second duct in communication with said first duct, said second duct communicating with an outlet duct of an elongate applicator which constitutes one piece with said push button, said second part being movable relative to said first part around a hinge to allow displacement of said second part between a storage position and a dispensing position in which dispensing position, said outlet conduit of said container is in communication with said first duct of said push button and the applicator is oriented substantially perpendicular to the container so that when a user acts on said push button, the product will be dispensed from said outlet conduit through said push button and applicator, and in said storage position, said push button is displaced out of communication with said outlet conduit and said applicator is oriented substantially parallel to and alongside the container.

2. A unit according to claim 1, wherein the push button and the applicator are made of a plastic material in one single piece by molding.

3. A unit according to either of claims 1 or 2, wherein the second duct of the push button and the duct of the applicator are extensions one of the other.

4. A unit according to any one of claims 1 or 2, wherein said first part of the dispensing head comprises wall means for guiding the second part of the dispensing head in its displacement between the storage position and the dispensing position.

5. A unit according to any one of claims 1 or 2, wherein the container is a pressurised container of the aerosol can type, and the discharge means is a valve.

6. The unit as claimed in claims 1 or 2 wherein said hinge is carried on said second part of said dispensing head in a zone with said zone separating the said push button from said applicator.

7. A unit as claimed in claims 1 or 2 wherein said hinge connects said first and second parts of said dispensing head and said hinge is a film hinge.

8. A unit according to any one of claims 1 or 2, further comprising a protective cap, capable of being positioned as an extension of the container.

9. The unit as claimed in claim 8 wherein said container has a surface envelope and the hinge connecting the first and second parts of the dispensing head is situated approximately on said surface envelope; and wherein said protective cap cooperates with the first part of said dispensing head, said second part thereof being situated outside said protective cap and said container.

10. A unit according to claim 8, wherein said container has a surface envelope and the hinge connecting the first and second part of the dispensing head is situated inside the surface envelope of the container; and wherein the dimensions of the second part of the dispensing head and of the protective cap are chosen so as to allow the dispensing head, in the storage position, to be completely accommodated in the internal space of the cap.

* * * * *